US006916036B1

(12) United States Patent
Egli

(10) Patent No.: US 6,916,036 B1
(45) Date of Patent: Jul. 12, 2005

(54) ADJUSTABLE TWO-POSITION SNOWBOARD BINDING MOUNT AND METHODS

(76) Inventor: Kent Egli, 11577 S. Finnegan's Way, Oregon City, OR (US) 97045

( * ) Notice: Subject to any disclaimer, the term of this patent is extended or adjusted under 35 U.S.C. 154(b) by 61 days.

(21) Appl. No.: 10/338,267

(22) Filed: Jan. 7, 2003

(51) Int. Cl.[7] ..... A63C 9/081
(52) U.S. Cl. ..... 280/618; 280/14.22
(58) Field of Search ..... 280/607, 617, 280/618, 14.21, 14.22

(56) References Cited

U.S. PATENT DOCUMENTS

| | | | |
|---|---|---|---|
| 4,037,978 | A | 7/1977 | Connelly |
| 4,728,116 | A | 3/1988 | Hill |
| 4,741,550 | A | 5/1988 | Dennis |
| 4,964,649 | A | 10/1990 | Chamberlin |
| 5,028,068 | A | 7/1991 | Donovan |
| 5,044,654 | A | 9/1991 | Meyer |
| 5,190,311 | A | 3/1993 | Carpenter et al. |
| 5,236,216 | A | 8/1993 | Ratzek |
| 5,261,689 | A | 11/1993 | Carpenter et al. |
| 5,277,635 | A | 1/1994 | Gillis |
| 5,354,088 | A | 10/1994 | Vetter et al. |
| 5,356,170 | A | 10/1994 | Carpenter et al. |
| 5,499,837 | A | 3/1996 | Hale et al. |
| 5,553,883 | A | 9/1996 | Erb |
| 5,577,755 | A | 11/1996 | Metzger et al. |
| 5,584,492 | A | 12/1996 | Fardie |
| 5,586,779 | A | 12/1996 | Dawes et al. |
| 5,667,237 | A | 9/1997 | Lauer |
| 5,732,959 | A | 3/1998 | Soejima |
| 5,782,476 | A | 7/1998 | Fardie |
| 5,791,678 | A | 8/1998 | Perlman |
| 5,803,481 | A | 9/1998 | Eaton et al. |
| 5,826,910 | A | 10/1998 | Ricks et al. |
| 5,868,416 | A | 2/1999 | Fardie |
| 5,890,729 | A | 4/1999 | Bayer et al. |
| 5,897,128 | A | 4/1999 | McKenzie et al. |
| 5,913,530 | A | 6/1999 | Berger et al. |
| 5,975,554 | A | 11/1999 | Linton |
| 5,984,325 | A | 11/1999 | Acuna |
| 6,015,161 | A | 1/2000 | Carlson |
| 6,102,430 | A | 8/2000 | Reynolds |
| 6,155,591 | A | 12/2000 | Huffman et al. |
| 6,196,569 | B1 | 3/2001 | Berger et al. |
| 6,203,051 | B1 | 3/2001 | Sabol |
| 6,206,402 | B1 | 3/2001 | Tanaka |
| 6,290,243 | B1 | 9/2001 | Beran |
| 6,302,411 | B1 | 10/2001 | Huffman et al. |

OTHER PUBLICATIONS

"Sk8-n-Ride", access on www.sk8-n-ride.com, , Jan. 7, 2003.

*Primary Examiner*—Bryan Fischmann
(74) *Attorney, Agent, or Firm*—Klarquist Sparkman, LLP

(57) ABSTRACT

A binding mount for mounting a binding to a snowboard includes a lower portion, an upper portion and a lock. The lower portion is attached to the snowboard and has a protruding lip with at least two circumferential notches corresponding to at least two positions between which the binding mount is selectively rotatable. The upper portion has an upper surface adapted to receive a binding and a lower surface that receives the protruding lip. The upper portion has first and second pieces that are removably assembled together at a junction extending through an axis of rotation. The lock is coupled to the upper portion and is actuatable by the user to selectively lock the position of the upper portion relative to the lower portion by engagement with any of the notches in the lip.

27 Claims, 8 Drawing Sheets

ADJUSTABLE TWO-POSITION SNOWBOARD BINDING MOUNT AND METHODS

FIELD

The invention relates to snow sports, and more particularly to adjustable snowboard binding mounts.

BACKGROUND

Snowboarding is a snow sport that combines elements of skateboarding and surfing. The snowboarder, or rider, straps his boots into left and right snowboard bindings, which traditionally are rigidly attached to the snowboard. One type of snowboard binding, as shown in FIG. 3, usually has two straps, one over the ball of the foot and one over the ankle. Most strap bindings provide the ability to adjust the angle of the foot relative to the snowboard.

A 0° tilt angle setting means that the foot (and the longitudinal axis of the binding) is perpendicular to the longitudinal axis of the snowboard. A 20° angle setting means that the binding is rotated 20° toward the front of the snowboard from the 0° position. For the purposes of this application, angles of the binding are measured relative to the longitudinal axis of the snowboard, so a 0° tilt angle is referred to as a 90°s position and a 20° tilt angle is referred to as a 70° position.

Riders generally prefer to have their left or right foot forward on the snowboard when going downhill, just as people generally prefer to write with their left or right hand. Riding with the left foot forward is known as a regular riding stance, and riding with the right foot forward is known as a goofy riding stance.

Beginning snowboarders generally prefer to have their front binding tilt angle set around 20°. Advanced riders who perform tricks generally prefer a 0° tilt angle on their front binding, because it allows them to easily ride with their back foot forward, as a regular stance rider might ride in a goofy stance for short periods.

One bothersome aspect of snowboarding is moving in a lift line. After the rider releases his rear boot from the rear binding, he must awkwardly skate or shuffle himself along with his front foot mostly perpendicular to the direction of travel, because the front foot remains in the front binding. Riding on a chairlift can be equally frustrating, because the hanging snowboard exerts a lateral torque on the front foot. In addition, a snowboarder may have to hold his snowboard in an uncomfortable position to prevent his snowboard from hitting other skiers or snowboarders, because almost every snowboard is longer than the width of a chairlift seat.

Other adjustable snowboard binding mounts providing for rotation between two positions are known, but they have not been widely accepted. For example, some adjustable binding mounts rely upon engagement between a portion of the binding and a member affixed to the board to stop further rotation, which limits the types of bindings that can be used with the binding mount. Some binding mounts require drilling of mounting holes in the snowboard in addition to the industry standard holes, which complicates installation and could lead to a weakened snowboard in some cases. In addition, known adjustable snowboard binding mounts require significant disassembly and/or substitute parts to reconfigure the binding mount of a regular stance rider for a goofy foot rider (or vice versa).

It would be advantageous to provide a binding mount that addresses the problems of the prior art.

SUMMARY

The adjustable snowboard binding mount of this application allows a rider to rotate the front binding from a riding position to a skating position, e.g., by unlocking the binding mount and rotating it, without releasing the front foot from the binding. In the skating position, the rider can move himself forward much like a skateboarder does with his front foot generally parallel to the longitudinal axis of the snowboard. Moving along in a lift line or sitting on a chairlift with the front foot in the skating position is much more comfortable than with the front foot in the riding position. The rider can then rotate his foot to transition from the skating position to the riding position with the binding mount automatically locking the binding in the desired riding position.

Advantageously, transitions from the skating position, sometimes called a "soft lock" position to the riding position can be made simply by applying a sufficient rotational force on the binding mount to rotate it from the skating position to the riding position. In some implementations, the required rotational force is set above a predetermined threshold to reduce occurrence of undesired transitions.

In the described implementations, transitions from the riding position to the skating position require the rider to perform a separate step in addition to rotating his foot. For example, in implementations described below, the rider unlocks a lock to rotate from the riding position (sometimes called the "hard lock" position) to the skating position.

Another feature of the binding mount is that it mounts to any snowboard with an industry standard threaded bolt hole pattern, whether it be the triangular pattern used on the snowboards sold under the BURTON trademark or the rectangular pattern used by others in the industry. Similarly, any binding with industry standard threaded mounting holes can be mounted to the binding mount. No drilling is required, and the binding mount does not require use of excess existing bolt holes that might limit the normally available fore/aft adjustment of the binding on the snowboard.

An additional feature of the binding mount is that it allows one to use a non-Burton style binding on a BURTON snowboard. BURTON snowboards use a triangular binding hole pattern as shown in FIG. 1. BURTON bindings can be mounted to snowboards using either the triangular pattern or the rectangular pattern shown in FIG. 2. Others in the industry manufacturer bindings that can only be mounted to snowboards that use the rectangular pattern. Because the binding mount can be mounted to snowboards with either a rectangular or triangular binding hole pattern, one can use it to mount any standard binding to a BURTON snowboard.

The binding mount can provide for two different stances and multiple angles of rotation with the same components, thereby allowing the binding mount to be reconfigured as a rider's preferences change, or for use by different riders.

DETAILED DESCRIPTION

Described below are implementations of an adjustable binding mount for attaching a binding to a snowboard or similar object (such as, e.g., a wakeboard), such that a user can selectively rotate his foot while it is secured in the binding to change between multiple positions, e.g., a riding position and a skating or shuttling position. The binding mount is attached to the snowboard, and the binding is attached to the binding mount. The binding mount is easily rotatable, when desired, without requiring the rider to disengage his boot from the binding.

Figure 3:
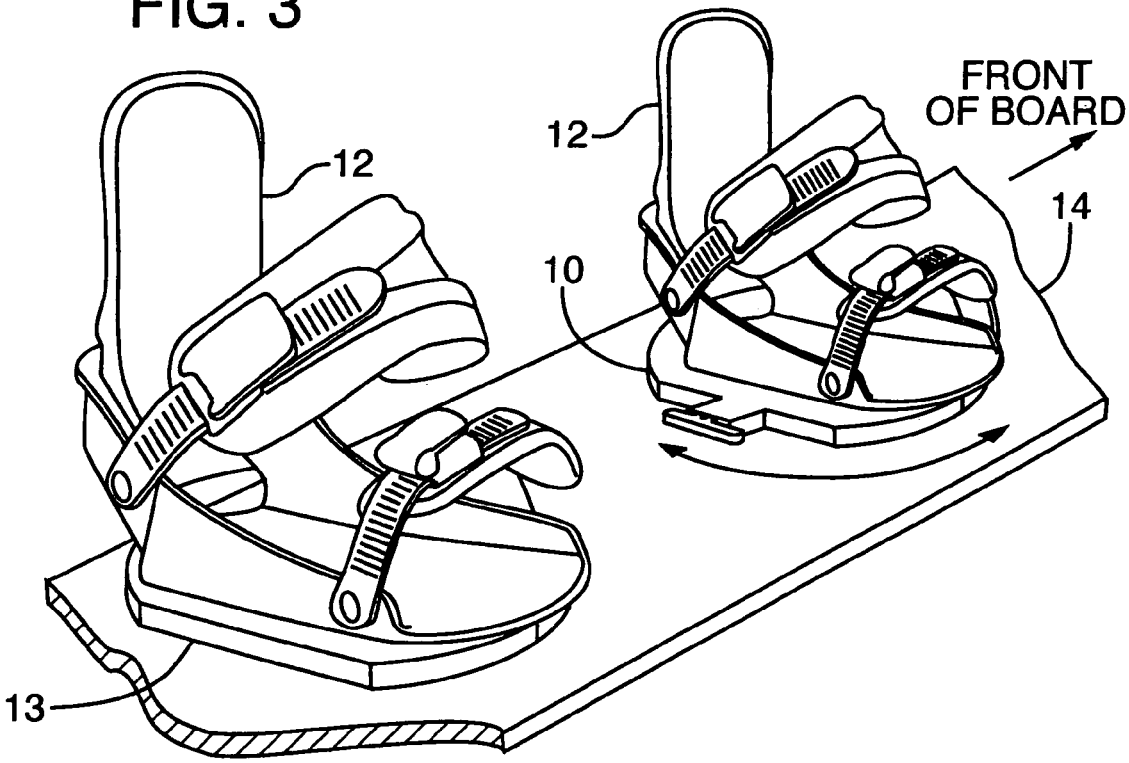
FIG. 3 is a perspective view showing a portion of a snowboard fitted with front and rear bindings, the front binding being mounted to the snowboard with an adjustable binding mount as described in this application.

An implementation 10 of the adjustable binding mount is shown in FIG. 3 with an attached binding 12, and as attached to a snowboard 14, in the forward (left foot) position for a regular stance rider. A second binding 12 for the right foot binding is mounted to a binding spacer 13 that has approximately the same thickness has the binding mount 10. A lever is positioned between the feet so that the rider can disengage the binding mount from the riding position with either hand or the back foot.

Construction

Figure 4:
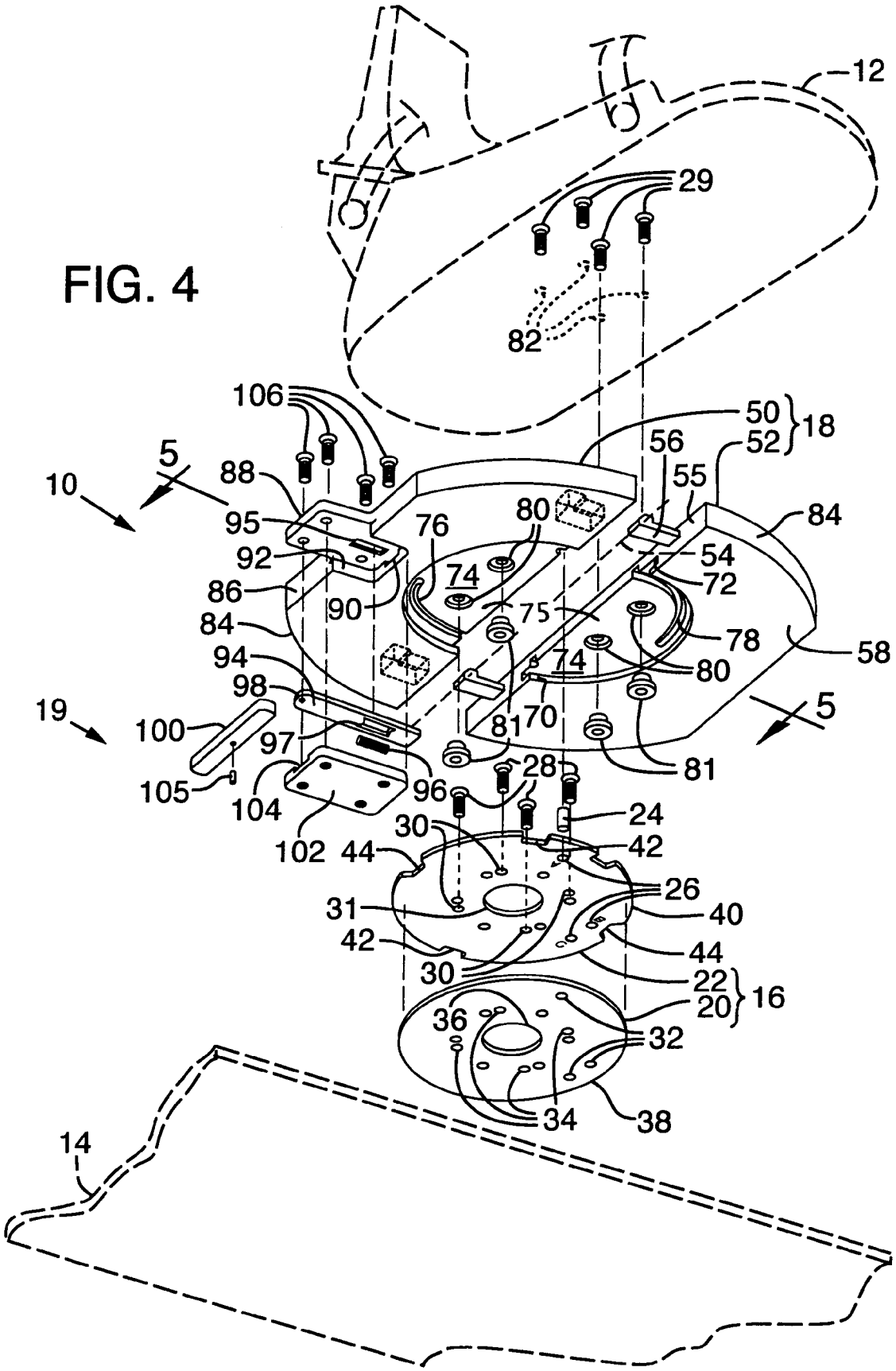
FIG. 4 is an exploded perspective view of the adjustable binding mount of FIG. 3.

Referring to FIG. 4, an exploded assembly view of the binding mount 10 is shown. The binding mount 10 is shown in an exploded state relative to a conventional binding 12 suitable for mounting to an upper surface of the binding mount 10 and the snowboard 14 to which the binding mount 10 is attached for use.

The binding mount 10 has a lower portion 16 and an upper portion 18 that is rotatably mounted to the lower portion 16. A lock 19 is provided to allow the upper portion 18 to be selectively secured in place relative to the lower portion 16, or released to allow the upper portion 18 to be rotated relative to the lower portion 16.

Lower Portion

The lower portion 16 is stationary and is rigidly attached to the snowboard 14.

In the illustrated implementation, the lower portion 16 includes a hub spacer part 20 and a separate hub part 22. In other implementations, it is possible to make the hub spacer part 20 and the hub part 22 as a single monolithic construction.

The lower portion 16 may also include a guide pin 24 positioned to project upwardly from the hub part 22. When assembled, as best shown in FIG. 5, a lower end of the guide pin 24 is received in one of the pin receiving holes 26 in the hub part 22 and an aligned one of the pin receiving holes 32 in the hub spacer part 20.

As illustrated, there are mounting bolts 28 that are inserted through mounting holes 30 in the hub part 22 and aligned mounting holes 34 in the hub spacer part 20 to attach the lower portion 16 to the snowboard 14. As is described below, the mounting holes 30, 34 are preferably arranged in an industry standard pattern.

The lower portion 16 may be shaped to reduce the overall weight of the binding mount 10 without sacrificing strength and rigidity. For example, in the illustrated implementation, the hub spacer part 20 has an optional cut out 36, and the hub part 22 has an optional cut out 31. The cut outs 36, 31 may be of any shape that does not inhibit operation of the binding mount 10.

Figure 5:
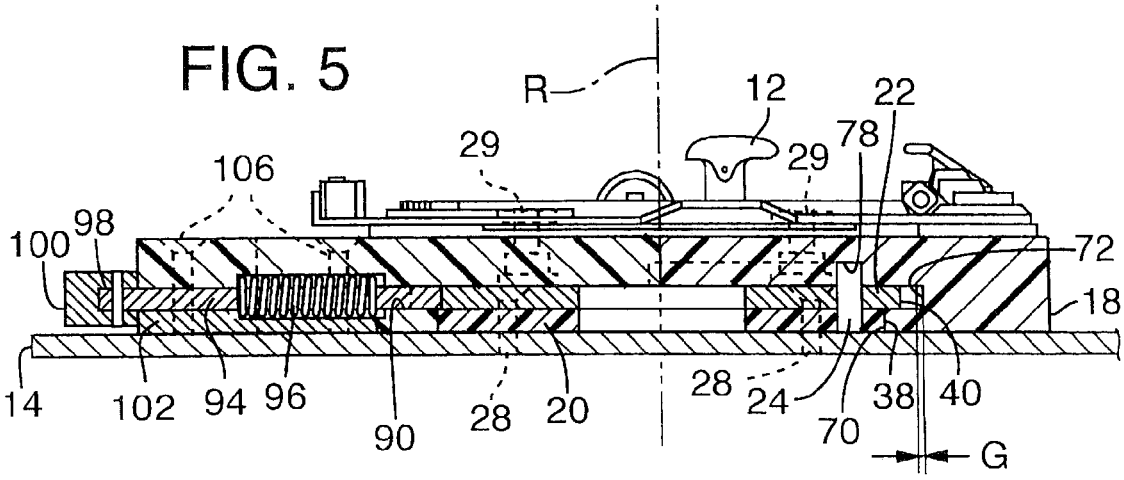
FIG. 5 is a cross sectional view in elevation of the assembled adjustable binding mount with a step-in binding.

The hub part 22 has a lip 40 that protrudes beyond a periphery 38 of the hub spacer part 20, as best seen in the section view of FIG. 5. In the illustrated implementation, the hub spacer part 20 is a generally circular disk and thus has a generally circular periphery, although other shapes are possible.

The protruding lip 40 is provided with at least one first position notch 42 and at least one second position notch 44. In the illustrated implementation, as best shown in FIG. 7, the hub part 22 has three first position notches 42 and two second position notches 44.

Figure 7:
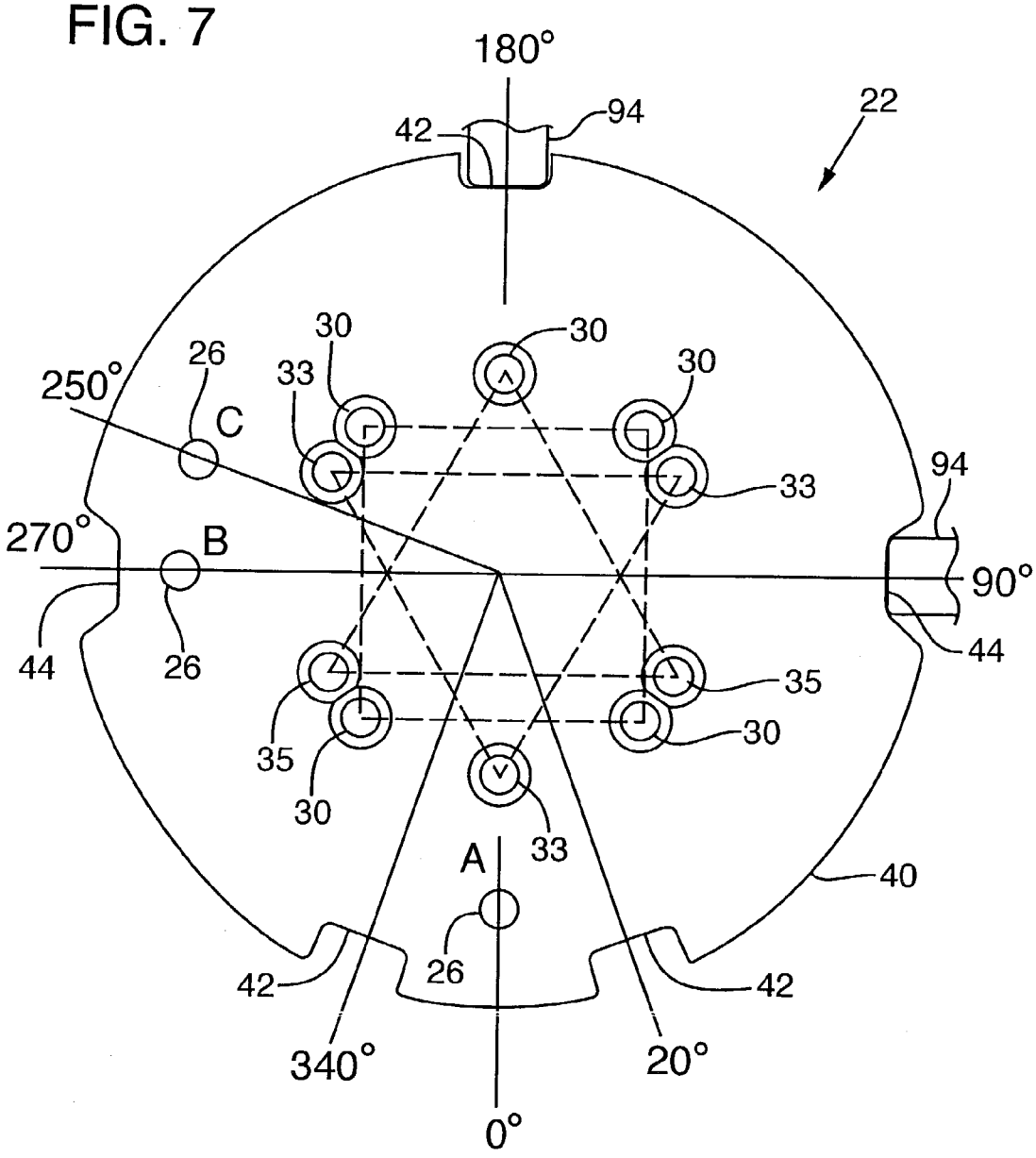
FIG. 7 is a plan view of the hub part showing a locking element engaged at different positions.

Referring to FIG. 7, each first position notch 42 has sides that are generally perpendicular to a base of the notch 42. Each second position notch 44 has sides that form an angle of less than 90° with a base of the notch 44. In the illustrated implementation, the notch 44 has sides that slope at an angle of about 45° although other angles are of course possible.

Upper Portion and Lock

The upper portion 18 is rotatable relative to the lower portion 16, and can be secured against rotation by actuating the lock 19.

The upper portion 18 includes a first piece 50 and a second piece 52 that are removably joined together at a junction 54 around the lower portion 16. In the illustrated implementation, the junction 54 extends through a rotational axis R of the binding mount 10. In plan view, the upper portion 18 has a pair of opposing curved sides 84 and a pair of opposing straight sides 86, with a tab projecting from one of the straight sides.

The upper portion 18 has a lower surface 58 in which a recess 74 is defined. A lip 70 on the lower surface 58 extends radially inward and defines an internal groove 72 dimensioned to receive the protruding lip 40 of the hub part 22.

If desired, one or both of a first guide pin groove 76 and a second guide pin groove 78 can be defined in a base 75 of the recess. The grooves 76, 78 are dimensioned to receive the projecting upper end of the guide pin 24, and to control the angular range of relative rotation between the upper portion 18 and the lower portion 16. In the base 75, there are also binding mount mounting features 80, including, e.g., threaded inserts 81. In the illustrated implementation, the binding 12 is attached to the binding mount 10 by binding mounting bolts 29 extending through holes 82 and being threadedly received in the inserts 81.

In the illustrated implementation, the lock 19 is coupled to and rotates with the upper portion 18. The first piece 50 has a projecting tab 88 and an adjacent radially extending slot 90. The radial slot 90 is dimensioned to receive an elongate lock member 94 and constrain it to move in a radial direction. The lock member 94 may be spring biased, e.g., by a spring 96 fit within an opening 95 of the lock member 94. An exposed end 98 of the lock member 94 is attached to a lever, such as the double-ended lever 100, by a pin 105.

In the illustrated implementation, the first piece 50 is formed with a cut-away 92 and includes a cover 102 shaped to fit within the cut-away 92. The cover has a groove 104 that extends the slot 90 and is also dimensioned to receive the lock member 94. The cover 102 is held in place by cover fasteners 106.

Figure 6A:
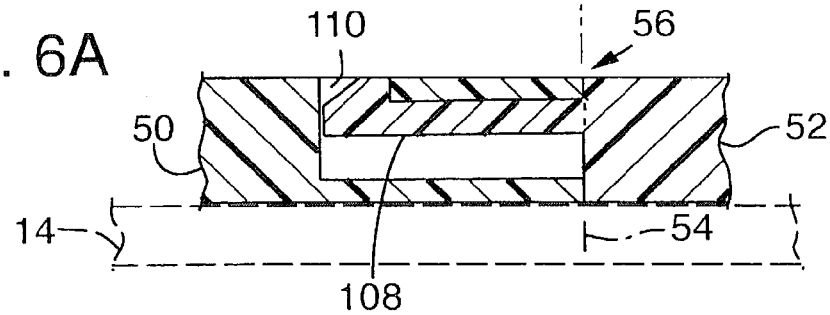
FIG. 6A is a cross sectional view of a portion of the binding mount showing a snap-fit connection between the pieces of the upper portion.

In the implementation of FIG. 4, the first piece 50 and the second piece 52 are removably joined together by one or more snap fit connections 56. Referring to FIG. 6A, each snap fit connection 56 is formed from a tab 108 extending from one of the pieces 50, 52 that is sized and shaped to extend through and engage an edge of a corresponding opening 110 formed in the other of the pieces 50, 52. In FIG. 6A, the snap fit connection 56 is shown in a locked state. To unlock the connection 56, the tab 108 is depressed to clear the edge of the opening 110, and the pieces 50, 52 are pulled apart from each other. If multiple snap fit connections 56 are used, the tabs 108 may be formed all on one of the pieces 50, 52 (as in FIG. 4), or with some tabs 108 on the piece 50 and the remainder of the tabs 108 on the piece 52.

Figure 6B:
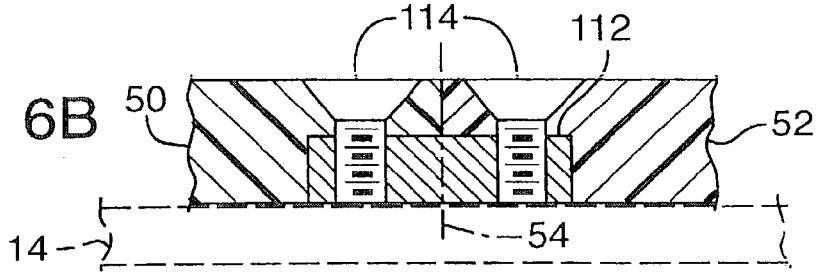
FIG. 6B is a cross sectional view of a portion of the binding mount showing a bolted connection between the pieces of the upper portion.

In an alternative implementation, the first piece 50 and the second piece 52 are removably joined together by a bolted connection. For example, referring to FIG. 6B, the first piece 50 and the second piece 52 can each be formed with a recess sized to accommodate a link member 112 extending across the junction 54 between the pieces 50, 52. The link member 112 has holes threaded to receive bolts 114 to secure each piece 50, 52 to the bridge part.

Alternatively, the link member 112 may be formed as one part with one of the upper portion pieces, thereby reducing the number of parts in the assembly. If the material of the upper portions is not suited for threading or if the threads would not be sufficiently strong, then suitable threaded inserts may be used.

Operation

The binding mount 10 permits the rider to rotate his foot relative to the snowboard between multiple positions while the foot remains secured in the binding attached to the binding mount.

Overview

In the following description, two such positions are described. A first position suitable for riding secures the rider's foot (within the binding 12) such that it is transverse to the snowboard, e.g., at an angle in the range of about 60° to 90° relative to a longitudinal axis of the snowboard. The first or riding position is illustrated in FIG. 3, which shows the forward binding for the left foot (regular stance) mounted to the snowboard 14 with the adjustable binding mount 10.

Figure 8A:
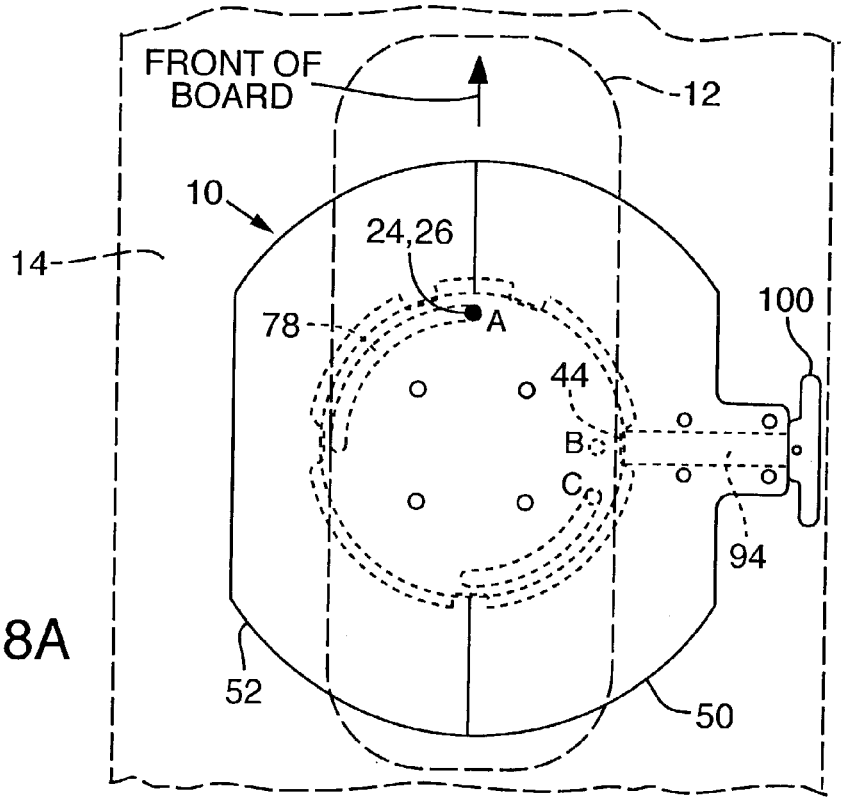
FIGS. 8A and 8B are plan views showing the binding mount relative to an attached binding and snowboard, with the engagement between a guide pin and a slot of the binding mount being configured for a regular stance and to permit a 90° rotation.

Because the riding position is awkward for shuttling or skating movements across flat areas, particularly in crowded lift lines, the binding mount 10 allows the rider to rotate his foot (and thus, the attached binding 12 and binding mount 10) from the first position to another position in which the foot is more aligned with the axis of the snowboard. One such position, referred to below as the second or skating position, allows the foot to be positioned roughly parallel with the axis of the snowboard. FIG. 8A is a plan view of the binding mount 10 in the second position showing the rider's foot (in the binding 12) roughly parallel with the axis of the snowboard.

For convenience, the binding mount 10 can be configured to allow the rider to rotate from the second position to the first position, e.g., when the rider exits the chairlift and is ready to resume downhill travel, simply by rotating his foot. Because no manual manipulation is required, riders are able to transition from sitting to riding more quickly. Inadvertent transitions from the second position to the first position can be reduced by -requiring a minimum rotational force set to require the rider's deliberate action to disengage from the second position.

For safety and performance, however, it is generally not desired to allow the rider to rotate from the first position (riding) to the second position (skating) solely by rotating his foot. The binding mount 10 in the implementation described below uses a positive locking scheme that prevents rotation from the first position to the second position unless a lock is unlocked, thus requiring a separate step before the foot can be rotated.

Detailed Operation

In the illustrated implementations, a mechanical lock is selectively engaged to prevent rotation of the upper portion 18 relative to the lower portion 16. One such mechanical lock is the lock 19, which is attached to and rotates with the upper portion 18.

As described above, the lock 19 includes a lever-actuated locking member 94 that is spring-biased in a radially inward direction to engage notches in the lip 40 of the lower portion as the upper portion 18 is rotated relative to the lower portion 16. When the lever 100 is actuated, the member 94 is urged outwardly against the action of the spring 96.

FIG. 7 shows the member 94 in each of two different types of positions. At the 3:00 o'clock (90°) position in FIG. 7, the member 94 is shown seated in one of the second position notches 44. If the rider desires to rotate from such a second position to a first position (such is as shown at the 12:00 o'clock (180°) position), he rotates his foot to generate sufficient force to turn the upper portion 18, with the attached member 94 being gradually urged outward against the force of the spring 96 by contact with the trailing one of sloping sides of the second position notch 44.

After an initial rotation sufficient to disengage the member 94 from the notch 44, the member 94 slides along the lip 40 until the first position notch 42 is encountered. When the member 94 is rotated into alignment with the first position notch 42, it engages the notch 42 automatically under the action of the spring 96.

The first position notch 42 and the second position notch 44 are separated from each other by a desired angle. One common angle is 90°. Some riders, however, prefer a lesser angle, e.g., 70°. Therefore, in the illustrated implementation, the hub part 22 is configured to provide for rotation angles of 90° and 70°. Additional angles, or different angles, could also be used, provided the notches are sufficiently spaced to be separate from one another and to have structural integrity.

In addition to the different angles of rotation, the binding mount 10 also provides for use by regular stance riders (left foot forward) and goofy stance riders (right foot forward), using the same components. The different options for configuring the binding mount 10 for different angles of rotation and different stances are described below in connection with FIGS. 8A to 8H.

In addition to the engagement between the lock member 94 and one of the notches 42, 44, the binding mount 10 can be configured as illustrated to include the guide pin 24 and the groove 76 and/or the groove 78. The groove 78 corresponds to the large angle, in this case 90°, and the groove 76 corresponds to the small angle rotation, in this case 70°.

The engagement between the guide pin 24, which is secured to the stationary lower portion 16, and either of the grooves 76, 78 formed in the rotating upper portion 18, prevents over-rotation when the binding mount 10 is being repositioned from the first position notch 42 to the second position notch 44 or vice versa.

In the illustrated implementation, there are three different pin receiving holes 26: Hole A is used for the regular stance for either the large angle rotation or the small angle rotation; Hole B is used for the goofy foot stance and the large angle rotation; and Hole C is used for the goofy foot stance and the small angle rotation.

FIGS. 8A–8H show how the binding mount 10 can be set up for different stances and different angles of rotation. The nose, or front of the snowboard is at the top of each figure, as indicated.

In FIG. 8A, the binding mount 10 is in the second position with the locking member 94 engaged in the second position notch 44. The binding mount 10 is set up for a regular stance rider using a large angle of rotation of about 90°. Thus, the hub part 22 and the hub spacer part 20 are mounted so that the Hole A is at 12 o'clock. The upper portion 18 is assembled such that the guide pin 24 will engage the groove 78 as shown.

Figure 8B:
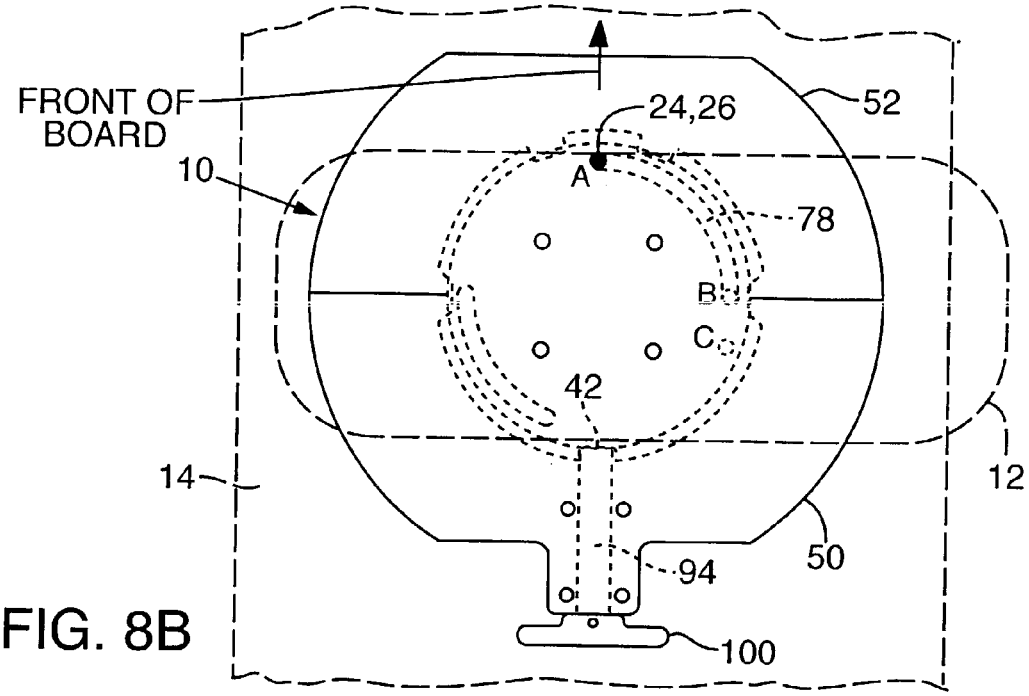

FIG. 8B shows the binding mount 10 of FIG. 8A, except that it has been rotated from the second position to the first or riding position. In FIG. 8B, the locking member 94 is engaged in the first position notch 42. As shown in FIG. 8B, the rotation of the upper portion 16 relative to the snowboard 14 has been limited by contact of the guide pin 24 in Hole A with the end of the slot 78.

Figure 8C:
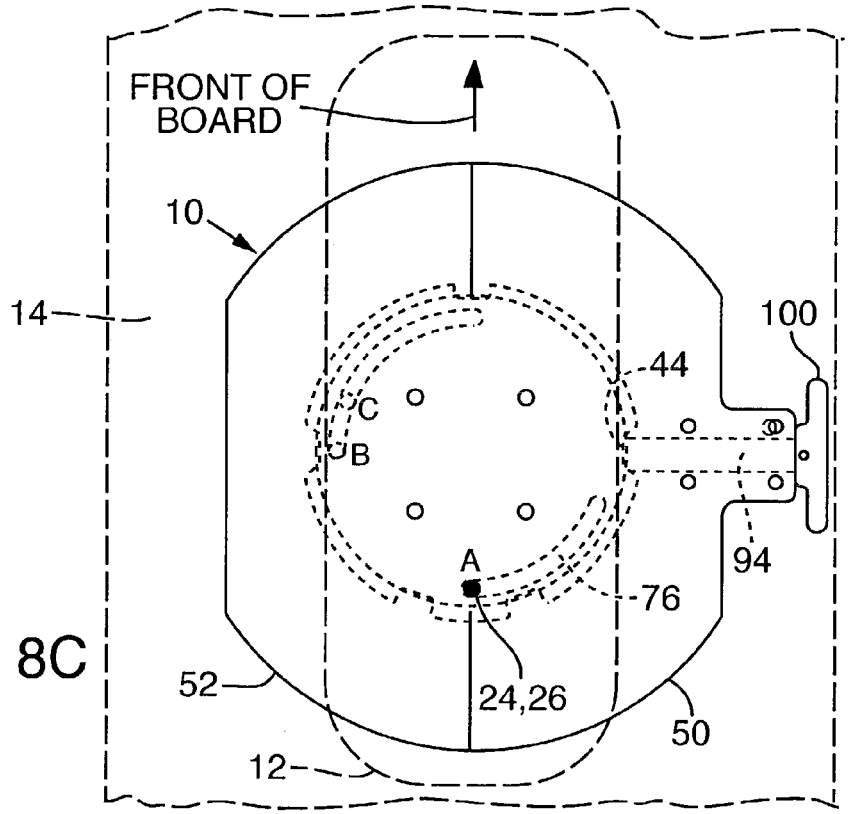
FIGS. 8C and 8D are similar to FIGS. 8A and 8B, except the binding mount is shown configured for a regular stance and to permit a 70° rotation.
Figure 8D:
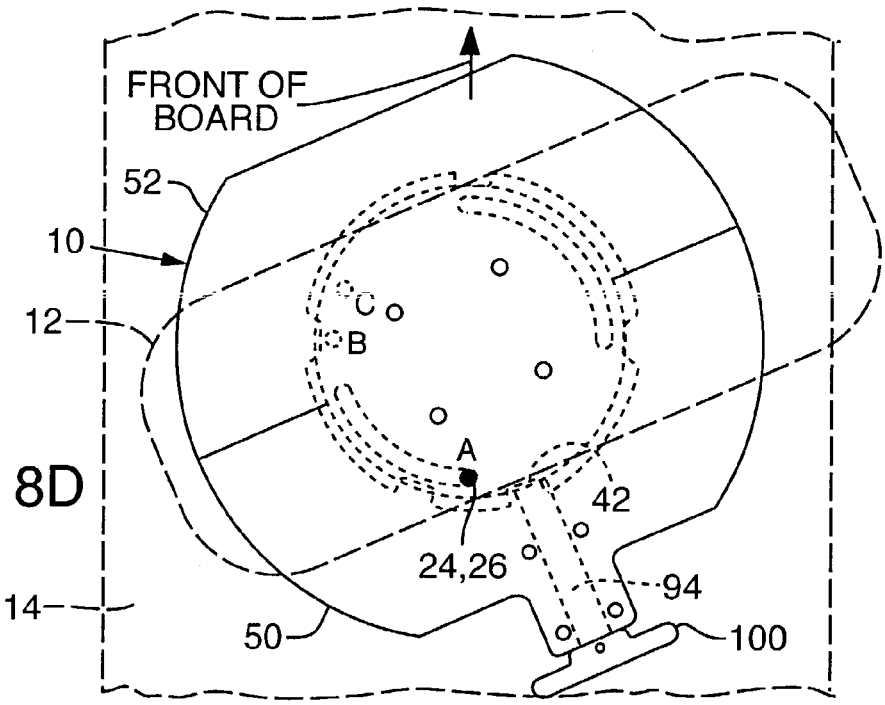

FIG. 8C is similar to FIG. 8A, except that the binding mount 10 is configured to allow only a small angle rotation of about 70°. Thus, as shown in FIG. 8C, the binding mount 10 is configured for a regular stance rider and, as shown in FIG. 8D, permits a rotation of about 70°. As shown in FIG. 8C and FIG. 8D, the guide pin 24 is inserted in Hole A and is engaged with the small angle groove 76. The lower portion 16 is mounted such that Hole A is positioned at 6 o'clock.

In FIG. 8D, the binding mount 10 is positioned in the first position. As shown, the rider's front foot is rotated about 70° relative to the axis of the snowboard 14.

Figure 8E:
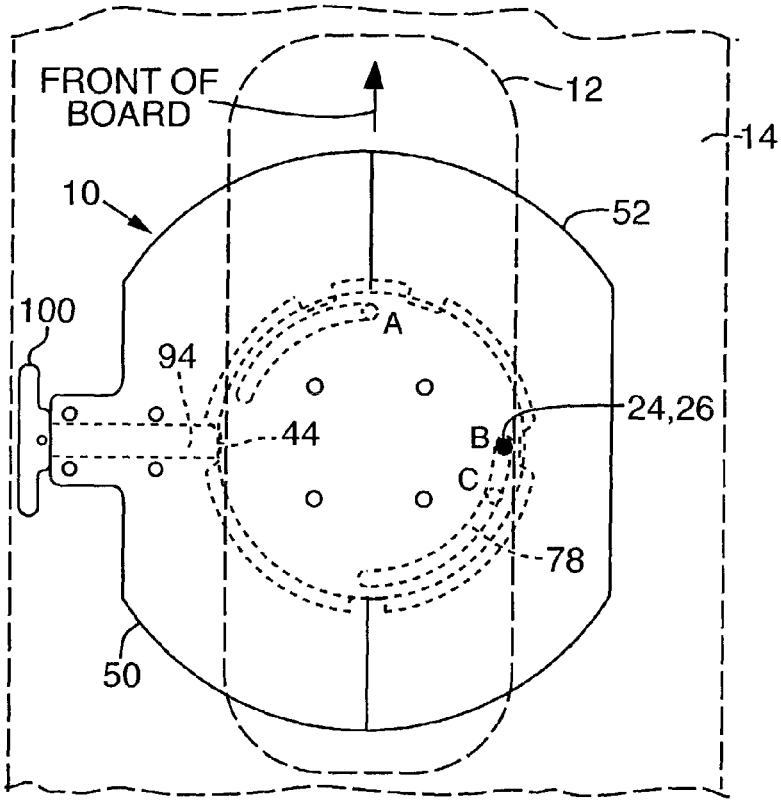
FIGS. 8E and 8F are similar to FIGS. 8A and 8B, except the binding mount is shown configured for a goofy stance and to permit a 90° rotation.
Figure 8F:
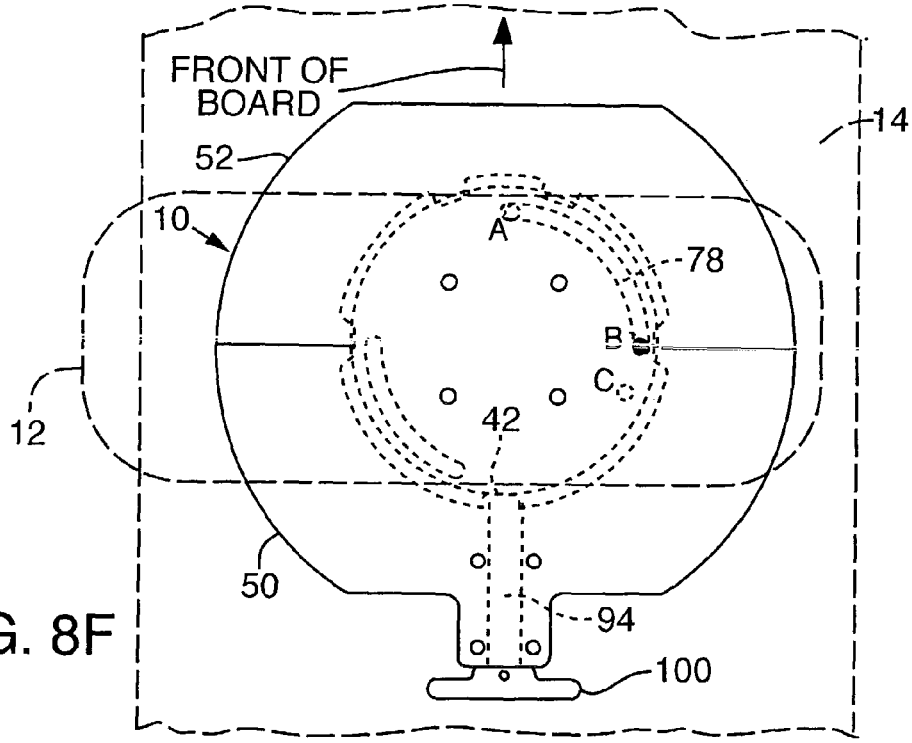

In FIG. 8E, the binding mount 10 is configured for a goofy stance rider and to allow a large angle rotation. The binding mount shown in FIGS. 8E and 8F is for the rider's right foot. The guide pin 24 is inserted in Hole B and is engaged in the large angle rotation groove 78.

FIG. 8F shows the binding mount 10 of FIG. 8E, but rotated to the first or riding position.

Figure 8G:
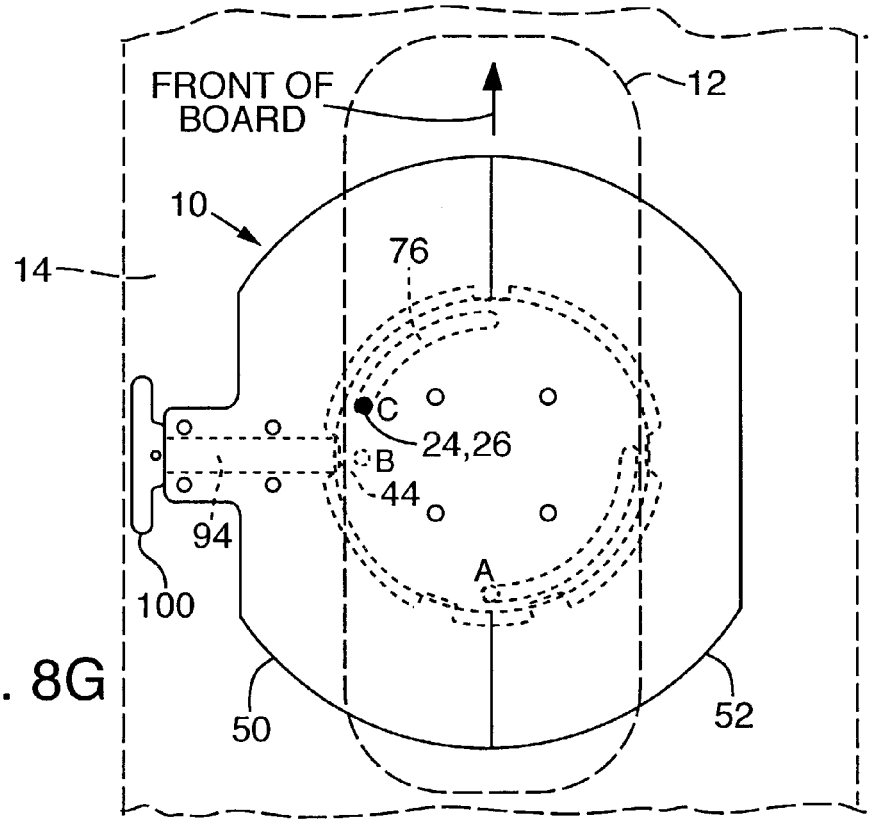
FIGS. 8G and 8H are similar to FIGS. 8A and 8B, except the binding mount is shown configured for a goofy stance and to permit a 70° rotation.

FIG. 8G is similar to FIG. 8E, and thus shows the binding mount 10 configured for a goofy stance rider, but is configured to allow only a small angle rotation. The guide pin 24 is inserted in Hole C and is engaged with the small angle rotation groove 76 as shown.

Figure 8H:
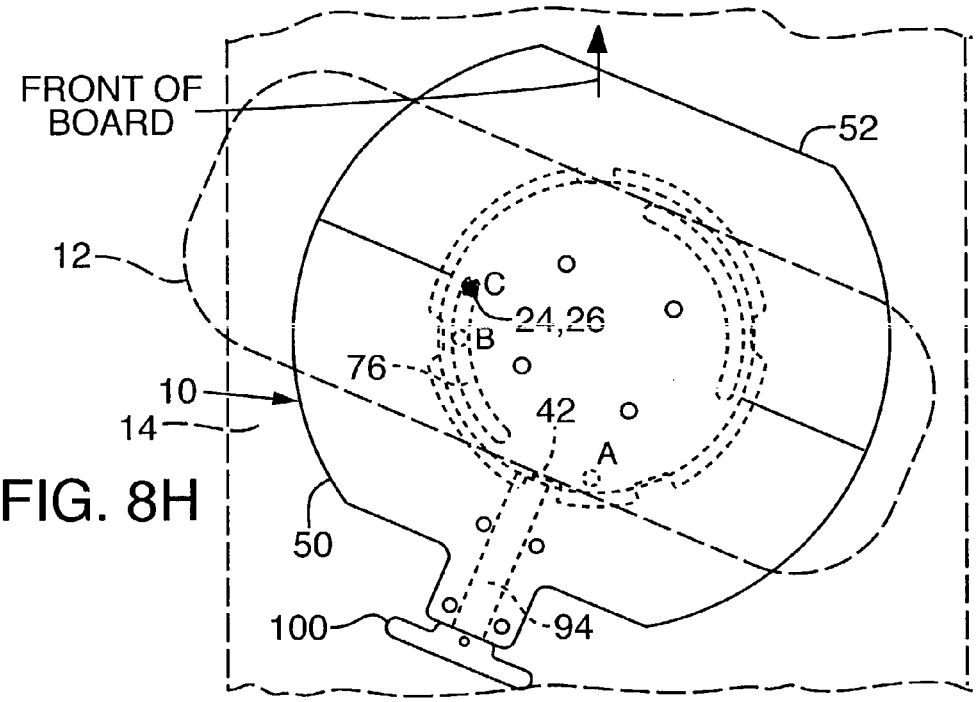

FIG. 8H shows the binding mount 10 of FIG. 8G, rotated to the first or riding position.

Actuating either end of the lever 100 moves the lock member 94 away from the hub part 22, effectively disengaging the lock member 94 from the notch 42 or the notch 44. The lever 100 is shaped to allow it to be actuated in either a clockwise or counterclockwise direction. This allows the use of either hand or the rear foot to disengage the lock. One advantage of the foot actuation is that it saves the rider the time and energy that it takes to bend over and disengage the lock with a hand.

In the cross section of the binding mount 10 shown in FIG. 5, the illustrated binding mounted to the binding mount 10 is what is known as a step-in snowboard binding. Step-in bindings, which are manufactured by companies such as K2 or Rossignol, are strapless snowboard bindings that allow for very quick binding entry and exit, just as clipless pedals allow for very quick entry and exit for bicyclists. A step-in boot contains a specific mechanical device meant to interface with a corresponding step-in binding. Step-in bindings are not usually compatible with step-in boots from other manufacturers. Any binding that can be mounted to a snowboard with an industry standard bolt hole pattern, whether it be a strap binding, step-in binding, or other variety of binding, can be mounted to the binding mount 10.

The cross section of FIG. 5 shows that the fit between the hub part 22 and the upper portion 18 restricts vertical movement of the upper portion 18, i.e., movement in the axial direction, while allowing rotation of the upper portion 18 relative to the hub part 22.

The hub part 22 is sized so that there is a radial gap G between its lip 40 and a base of the groove 72 so that thermal expansion and contraction of the hub part 22 and upper portion 18 will not cause any binding to occur. Play in the radial direction is reduced by a close fit between the hub spacer part 22 and the adjacent lip 70 of the upper portion 18.

The hub spacer part 20 and upper portion 18 ideally are made of materials with similar coefficients of expansion to prevent binding at cold temperatures. If the hub part 22 and the upper portion 18 have similar coefficients of expansion, the hub part 22 and hub spacer part 20 may be formed as a single piece. If the hub part 22 and the hub spacer part 20 are separate pieces, they may be joined together as a unit, such as, e.g., by contact cement or other suitable adhesive to improve ease of handling and assembly.

The upper portion 18 and hub spacer part 20 may ideally be made from a high performance engineering thermoplastic such as Phillips 66 Ryton® and may contain glass and/or carbon fiber reinforcement. The hub part 22 and lock member 94 may ideally be made of a hard anodized aluminum.

Mounting the Binding Mount to the Snowboard

Figure 1:
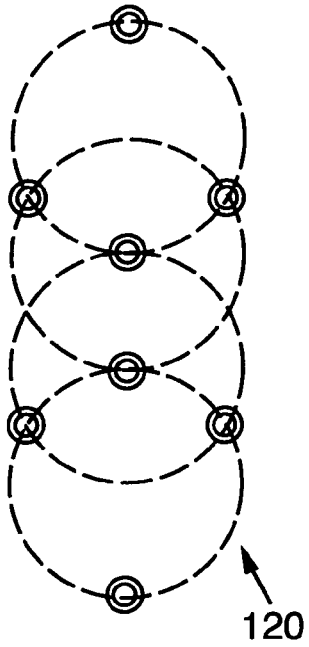
PRIOR ART FIG. 1
FIG. 1 is a schematic plan view of a prior art triangular binding mount bolt hole pattern used for mounting bindings to snowboards.

The first step to mounting the binding mount 10 is to mount the hub part 22 and hub spacer part 20 to the snowboard 14 using mounting bolts 28. If the snowboard has a triangular bolt hole pattern as shown in FIG. 1, then three mounting bolts 28 are inserted through the mounting holes 33 or the mounting holes 35 of the hub part 22 and the corresponding holes of the hub spacer part 20 and are threaded into the threaded bolt holes 120 (FIG. 1). It should be obvious that the hub part 22 and hub spacer part 20 can be mounted to any three threaded bolt holes 120 as long as the threaded bolt holes 120 are the vertices of an equilateral triangle. The dashed circles in FIG. 1 indicate the possible groups of threaded bolt holes 120. The orientation of the hub part 22 and hub spacer part 20 relative to the snowboard 14 are discussed above, depending upon the desired stance and rotation angle. Whether the mounting holes 33 or the mounting holes 35 are used will depend on the set of threaded bolt holes 120 chosen to receive the mounting bolts 28, the rotation angle, and the rider stance.

Figure 2:
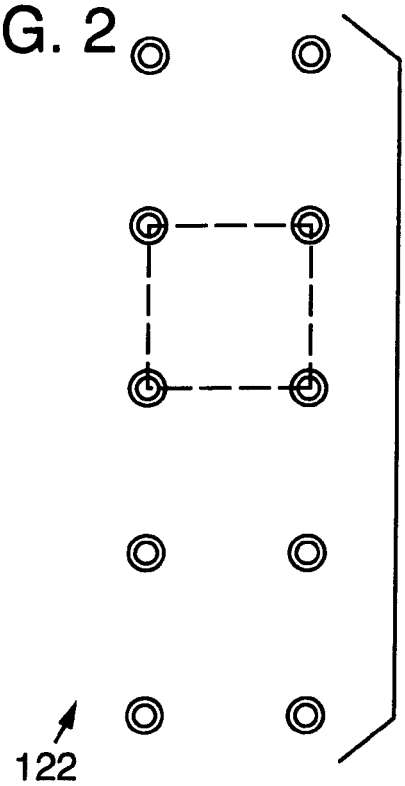
PRIOR ART FIG. 2
FIG. 2 is a schematic plan view of a prior art rectangular binding mount bolt hole pattern used for mounting bindings to snowboards.

If the snowboard has a rectangular bolt hole pattern as shown in FIG. 2, then four mounting bolts 28 are inserted through the mounting holes 30 (FIG. 7) of the hub part 22 and the mounting holes 34 (FIG. 4) of the hub spacer part 20 and are threaded into the threaded bolt holes 122 (FIG. 2). It should be obvious that the hub part 22 and hub spacer part 20 can be mounted to any four threaded bolt holes 122 as long as the threaded bolt holes 122 are the vertices of a square. The dashed square in FIG. 2 is an example of a possible group of threaded bolt holes 122. The orientation of the hub part 22 and hub spacer part 20 relative to the snowboard are as discussed above.

The upper portion 18 is coupled to the assembled lower portion 16 by sliding the first piece 50 and the second piece 52 towards each other with the lip 40 received in the groove 72. The first piece 50 and the second piece 52 are secured together with the snap-fit connection 56 or a bolted connection, as described above.

FIG. 3 shows the rear snowboard binding 12 mounted to the snowboard 14 with a binding spacer 13. The binding spacer 14 has a thickness approximately the same as the binding mount 10 so that the rider's feet are approximately level with respect to each other.

Having illustrated and described the principles of my invention with reference to several exemplary embodiments, it should be apparent to those of ordinary skill in the art that the invention may be modified in arrangement and detail without departing from such principles. I claim all such modifications that fall within the scope of the following claims.

I claim:

1. A binding mount for mounting a binding to a snowboard, the binding mount being selectively rotatable between at least two different positions, the binding mount comprising:

a lower portion for attachment to the snowboard, the lower portion having a generally circular protruding lip spaced from the snowboard when the lower portion is attached to the snowboard, the lip having at least two circumferential notches corresponding to the at least two different positions;

an upper portion having an upper surface adapted to receive a binding and a lower surface defining an internal groove shaped to receive the protruding lip of and rotate relative to the lower portion;

the upper portion comprising first and second pieces that are removably assembled together at a junction extending through an axis of rotation for the binding mount; and a lock coupled to the upper portion and actuatable by a user to selectively lock the position of the upper portion relative to the lower portion by engagement with any of the notches in the lip of the lower portion.

2. The binding mount of claim 1, wherein the first and second pieces are assembled together with a snap fit connection.

3. The binding mount of claim 1, wherein the first and second pieces are assembled together with at least one bolted connection.

4. The binding mount of claim 1, wherein the first piece of the upper portion has a projecting tab to which the lock is coupled, the lock having a spring-biased member projecting through a slot in the first piece.

5. The binding mount of claim 4, wherein the first piece includes a lock cover securable to the projecting tab.

6. The binding mount of claim 1, wherein the lower portion is attachable to the snowboard using industry standard binding bolt holes in the snowboard.

7. The binding mount of claim 1, wherein the lower portion has a peripheral edge spaced inwardly from the protruding lip that contacts an adjacent portion of the upper portion, thereby reducing play between the upper portion and the lower portion in a radial direction relative to the axis of rotation.

8. The binding mount of claim 7, wherein there is a gap in a radial direction between the lip of the lower portion and the groove of the upper portion in which the lip is received when the upper portion and the lower portion are assembled together.

9. The binding mount of claim 1, wherein the lock includes a spring-biased member with an inner end sized to engage any of the notches and the upper portion has a radial slot within which the member travels.

10. The binding mount of claim 9, wherein the lock includes a lever coupled to an outer end of the member, the lever being pivotable to move the member in a radial direction to engage and disengage the lock.

11. The binding mount of claim 10, wherein the member has a slot defined therein and a spring sized to fit within the slot.

12. The binding mount of claim 10, wherein the lever is double ended.

13. The binding mount of claim 10, wherein the lever has at least one elongate end allowing the lever to be foot actuated by a user.

14. The binding mount of claim 1, wherein the upper portion includes at least one curved slot and the lower portion has a projecting pin sized to travel within the curved slot when the upper portion and the lower portion are assembled together, the curved slot having ends that define limits for rotation of the upper portion relative to the lower portion.

15. The binding mount of claim 14, wherein the upper portion includes separate first and second curved slots for different rotation angles.

16. The binding mount of claim 15, wherein the first curved slot transcribes an arc of about 90 degrees and the second curved slot transcribes an arc of about 70 degrees.

17. The binding mount of claim 15, wherein the lower portion has multiple apertures within which the pin can be positioned, each aperture providing for a different set of the at least two different positions.

18. The binding mount of claim 1, wherein the upper portion includes at least three binding bolt holes arranged in an industry standard pattern.

19. The binding mount of claim 18, wherein the upper portion is formed of a plastic, a composite or a metal, and wherein the binding bolt holes are fitted with internally threaded fasteners sized to receive standard binding bolts.

20. The binding mount of claim 1, wherein the upper portion has a periphery that includes a pair of opposing rounded sides and a pair of opposing straight sides.

21. The binding mount of claim 20, wherein the opposing rounded sides and opposing straight sides approximate a footprint shape of a binding.

22. The binding mount of claim 1, wherein at least one of the notches is shaped such that the lock may be disengaged by a rotational force on the upper portion.

23. A binding mount for mounting a snowboard binding to a snowboard, the binding mount being selectively rotatable between at least first and second positions, the binding mount comprising:

a lower portion for attachment to the snowboard, the lower portion having a protruding lip with at least one first position notch and at least one second position notch, the first position notch having non-sloping edges and the second position notch having sloping edges;

an upper portion having an upper surface for receiving a snowboard binding, the upper portion fitting around and being rotatable relative to the lower portion; and a lock coupled to the upper portion and engageable with the first position notch or the second position notch, wherein the upper portion is automatically releasable from the second position without actuating the lock by rotating the upper portion relative to the lower portion, the rotation causing the lock to disengage from the second position notch, and wherein the upper portion cannot be released from the first position without actuating the lock to disengage the lock from the first position notch.

24. The binding mount of claim 23, wherein the protruding lip has at least three first position notches and at least two second position notches.

25. A binding mount for mounting a binding to a snowboard, the binding mount being selectively rotatable between at least two different positions, the binding mount comprising:

a lower portion for attachment to the snowboard, the lower portion having a generally circular protruding lip spaced from the snowboard when the lower portion is attached to the snowboard, the lip having at least two notches corresponding to the at least two different positions;

an upper portion having an upper surface adapted to receive a binding and a lower surface defining an internal groove shaped to rotatingly engage the protruding lip of and rotate relative to the lower portion;

the upper portion comprising first and second pieces removably assembled together at a pull-apart junction; and a lock coupled to the upper portion and actuatable by a user to selectively lock the position of the upper portion relative to the lower portion by engagement with any of the notches in the lip of the lower portion.

26. A binding mount for mounting a binding to a snowboard, the binding mount being selectively rotatable between at least two different positions, the binding mount comprising:

a lower portion for attachment to the snowboard, the lower portion having a guide pin and a hub part;

the hub part being disc shaped, the hub part having a lip that protrudes beyond a periphery of the spacer part, the lip having at least one first position notch and at least one second position notch, the second position notch being angularly spaced from the first position notch by an angle of rotation, the hub part having mounting fastener holes and at least one guide pin hole;

the guide pin being received in aligned guide pin holes of the respective spacer part and hub part, the guide pin being having an upper end extending upward from the hub part;

a two-piece upper portion having a lower surface with a lip defining a recess and an internal groove for receiving the protruding lip of the hub part, thereby rotatingly engaging the upper portion with the lower portion, the lower surface also having at least one guide pin groove dimensioned to receive the upper end of the guide pin and to limit rotation of the upper portion relative to the lower portion, the two piece upper portion including a first piece and a second piece removably joined together at a junction extending through a rotation axis of the binding mount; and the first piece having a projecting tab and an aligned radial slot for mounting a lock, the lock comprising a spring-biased member with an inner end sized to engage any of the notches, the spring-biased member having a slot defined therein and a spring sized to fit within the slot, a lock cover securable to the projecting tab, and a lever coupled to an outer end of the member, the lever being pivotable to move the member in a radial direction to engage and disengage the lock, the lever having at least one elongate end, wherein actuating the lever to retract the member from the first position notch allows the rider to rotate from the first position to the second position.

27. For a rotatable binding mount, mounted to a snowboard and a snowboard binding, a method of changing a rotation angle or riding stance, the method comprising:

removing the snowboard binding from the binding mount;

separating first and second pieces of an upper portion of the binding mount;

removing a pin from a lower portion of the binding mount;

removing, reorienting, and reattaching the lower portion to the snowboard for a desired rotation angle or riding stance, if necessary;

inserting the pin into an appropriate hole in the lower portion;

reattaching the first and second pieces of the upper portion; and reattaching the snowboard binding to the binding mount.

* * * * *